US008393687B2

(12) United States Patent
Powell

(10) Patent No.: US 8,393,687 B2
(45) Date of Patent: Mar. 12, 2013

(54) RACK BAR HAULAGE SYSTEM WITH AN IMPROVED RACKBAR

(75) Inventor: Gordon Powell, Malvern (GB)

(73) Assignee: Joy MM Delaware, Inc., Wilmington, DE (US)

( * ) Notice: Subject to any disclaimer, the term of this patent is extended or adjusted under 35 U.S.C. 154(b) by 99 days.

(21) Appl. No.: 12/752,833

(22) Filed: Apr. 1, 2010

(65) Prior Publication Data

US 2011/0239896 A1 Oct. 6, 2011

(51) Int. Cl.
*E21C 29/02* (2006.01)

(52) U.S. Cl. ..... 299/42

(58) Field of Classification Search ..... 299/42
See application file for complete search history.

(56) References Cited

U.S. PATENT DOCUMENTS

| | | | | |
|---|---|---|---|---|
| 4,155,600 | A | 5/1979 | Lanfermann et al. | |
| 4,256,345 | A * | 3/1981 | Schwarting et al. | 299/43 |
| 4,515,410 | A * | 5/1985 | Trumper et al. | 299/43 |
| 4,850,648 | A * | 7/1989 | Muller | 299/43 |
| 6,571,936 | B1 | 6/2003 | Melhuish et al. | |

FOREIGN PATENT DOCUMENTS

| | | |
|---|---|---|
| GB | 1599087 | 9/1981 |
| GB | 2196366 A * | 4/1988 |
| GB | 2211525 | 7/1989 |
| GB | 2452717 | 1/2011 |
| PL | 113450 | 12/1980 |

OTHER PUBLICATIONS

British Examination Report dated Jul. 5, 2011, Application No. GB1105494.7, 3 pages.
Polish Search Report dated Jul. 28, 2011, Application No. P-394426, 2 pages.
Examination Report for Application No. GB 1105494.7 dated Oct. 31, 2012 (1 page).

* cited by examiner

*Primary Examiner* — John Kreck
(74) *Attorney, Agent, or Firm* — Michael Best & Friedrich LLP

(57) ABSTRACT

A rack bar haulage system including a plurality of rack bars, each having spaced apart gear teeth extending between cheek sections at opposite sides of the rack bar. The haulage system also includes a clog including two spaced apart sidewalls, and openings through the sidewalls. One cheek section has a clog wall receiving cavity adapted to receive one of the clog sidewalls, the clog wall receiving cavity being defined by spaced apart cheek section flanges. The cheek section flanges each have an opening there through, and the cheek section flange openings are aligned with the clog sidewall openings. A pin is insertable through the sidewall openings and the openings in the cheek section flanges, and the spaced apart cheek sections are positioned so that the envelope formed by the gear teeth is at the same level on the rack bar as the pin for retaining the rack bar in the clog.

5 Claims, 5 Drawing Sheets

RACK BAR HAULAGE SYSTEM WITH AN IMPROVED RACKBAR

BACKGROUND

This disclosure relates to rack bar haulage systems and the means by which the rack bars are secured and retained to armor face conveyors, in particular, though not necessarily exclusively, for underground longwall mining.

Longwall conveyors normally operate with a powered coal-cutting machine, a shearer that is mounted onto the face conveyor. The shearer hauls itself along the face conveyor in both directions by means of a haulage system. A rack bar haulage systems comprise a series of rack bars pinned to support brackets, called clogs, welded to the individual armor face conveyor elements, the line pan. The shearer engages with the racks via a shoe that permits free movement in the direction of shearer travel only. The shoe also houses a drive sprocket that engages the gear teeth to provide the required haulage load to cut the mined material. The shearer drive gear wheel meshes with uniformly spaced horizontal teeth extending between two spaced apart cheek plates to form the rack bar.

All rack systems must withstand shearer haulage forces in various directions and their retention methods must cope with the tendency of the shearer shoe to bulldoze material in front of it as it passes along the conveyor.

In conventional longwall mining, as illustrated in FIGS. 1-2 taken from Lanfermann et al U.S. Pat. No. 4,155,600, a drum cutter mining machine 1 is traversed along a face conveyor 2 by means of a driving wheel 3 secured to a longwall shearer 4. The driving wheel 3 meshes with a gearwheel or drive sprocket 5 that is rotatably supported on the machine frame 6 forming part of the drum cutter mining machine. The teeth of the drive sprocket 5 mesh with rack gear teeth of a rack bar or device 7.

As illustrated in FIG. 2, the face conveyor 2 is made up of a plurality of conveyor pan sections or line pans 9 joined together end-to-end by connecting elements 8. By means of these connecting elements, the conveyor pan sections are maintained movable with respect to each other so that the conveyor pan sections are adaptable to characteristics of the mine floor. The individual conveyor pan sections are connected together by the connecting elements 8 to provide not only limited mobility with respect to each other in the horizontal direction of the conveyor 2, but also to provide vertical or horizontal angling of one conveyor pan section with respect to another when set on the mine floor. The rack device 7 that is mounted onto the face conveyor 2 undergoes the same horizontal motions as the conveyor pan sections. When the face conveyor is shifted, the rack device also undergoes the same vertical angular motions which the conveyor pan sections undergo particularly when it is desired to work undulating portions of a mine seam. The rack device 7 includes a plurality of elongated rack bars consisting of movable rack bars 7*a* and immovable rack bars 7*b*. Holders or clogs 10 that are directly or indirectly connected to the face conveyor 2 support all the rack bars. Connecting bolts 11 are used to join the individual rack bars to the clogs 10.

The movable and immovable rack bars 7*a* and 7*b*, respectively, of the rack device 7 are provided at both ends of each segment with a nose-shaped extension 12 which projects downwardly. This extension includes a bore for accommodating a connecting bolt 11 forming a pivot shaft. As shown in FIG. 1, the movable rack bars 7*a* bridge a joint A between the conveyor pan sections. The movable rack bars 7*a* are mounted onto the same two holders 10 which are used to mount one end of adjacent immovable rack bars 7*b*. These immovable rack bars are each entirely disposed to extend along a single conveyor pan section. Thus, two rack clogs 10 are secured at spaced-apart locations to a conveyor pan section. Each immovable rack bar 7*b* is secured by connecting bolts or pins 11 at its opposite ends to the two rack holders which additionally support the adjacent ends of movable rack bars.

Each of the clogs 10 is provided with a slot 13 located on one-half of the holders that is nearest the joint between the conveyor pan sections. The slots 13 in the clogs 10 extend in a direction corresponding to the longitudinal orientation of the face conveyor. The connecting pins 11 extend through the slots and provide the associated movable rack bar 7*a* with adequate mobility with respect to the face conveyor. The immovable rack bars 7*b* are fixed with respect to the face conveyor 2 by the connecting bolts 11 which retain these rack bars by extending through bores 13' formed in the remaining half of the holders 10. Each bore 13' corresponds to the diameter of the pin 11.

Thus, it is common to have two rack bars 7 per line pan 9. One rack bar 7*b* is fixed in the center of the line pan 9, and the second rack bar 7*a* spans the joint between adjacent line pans 9. Relative articulation between line pans during the mining process can cause the inter-pan gap to vary considerably and this could cause problems as the shearer drive sprocket 5 moves from the fixed rack bar 7*b* to the inter-pan rack bar 7*a*, if the inter-pan rack bar is firmly pinned to either adjacent pan. The common solution is for the inter-pan rack bar pins 11 to be retained in slots 13 in the clogs 10 rather than holes. In this manner, the error in tooth pitch between adjacent rack bars is halved and is kinder to the shearer sprocket 5, but causes added difficulty with pin retention, as the pin 11 must be allowed to move along the slot 13.

More particularly, as shown in FIGS. 3, 4 and 5, the longwall line pans 9 include a goaf side fabrication or shield plate 14. The shield plate 14 is located adjacent the rack bar haulage system. In order to secure the rack bar 7 to the clog 10, the pin 11 is inserted into the clog 10 through an opening 15 in the shield plate 14.

The clog 10 has a width corresponding to the width of the nose-shaped extension 12, and the clog 10 defines a cavity for engaging and providing support for the rack bar 7 by receiving the nose-shaped extension 12, the cavity being defined by two spaced apart bracket sidewalls 16, and end walls 17 connecting the sidewalls 16. The clog 10 also has openings 18 through the sidewalls 16, the pin 11 being insertable through one sidewall opening 18 and being received in the other sidewall opening 18.

The pin has a head 19 that is larger than the opening through the sidewall of the clog 10, so the pin 11 cannot pass through the clog 10. In order to retain the pin 11 within the clog 10, a retainer plate 20 is dropped into the area between the head of the pin 11 and the shield plate 14. The retainer plate 20 prevents the pin 11 from coming out of the clog 10.

Thus, as shown in FIGS. 3-5, the conventional rack bars 7 are retained in the clogs 10 by the headed pins 11 that can only be assembled through the opening 15 in the goaf side shield plate 14. The headed pins 11 are themselves retained by the retainer plates 20 that locate in lugs 21 welded to the goaf side shield plate 14. The retainer plates 20 are kept in place by gravity alone, but can be made more secure with another fastener, such as a bolt or a spring pin.

The primary role of the clog 10 is to provide fixing points on the line pans 7 for the semi-flexible rack bar system along which the shearer hauls itself in order to cut material from the seam. The nature of the system is that rack bars 7 are easily replaced if damaged, but the clogs 10 cannot be repaired in a hazardous environment, as the required cutting and welding is prohibited. Hence there is a need for a strong, reliable, simple rack-clog retention assembly.

SUMMARY

It is an object of this disclosure to provide a rack bar haulage system with lower gear teeth, thus permitting longwall mining in lower mine seams.

This disclosure provides a rack bar haulage system including a plurality of rack bars, each having spaced apart gear teeth extending between cheek sections at opposite sides of the rack bar. The haulage system also includes a clog including two spaced apart sidewalls, and openings through the sidewalls. One cheek section has a clog wall receiving cavity adapted to receive one of the clog sidewalls, the clog wall receiving cavity being defined by spaced apart cheek section flanges. The cheek section flanges each have an opening there through, and the cheek section flange openings are aligned with the clog sidewall openings. A pin is insertable through the sidewall openings and the openings in the cheek section flanges, and the spaced apart cheek sections are positioned so that the envelope formed by the gear teeth is at about the same level on the rack bar as the pin for retaining the rack bar in the clog.

Figure 1:
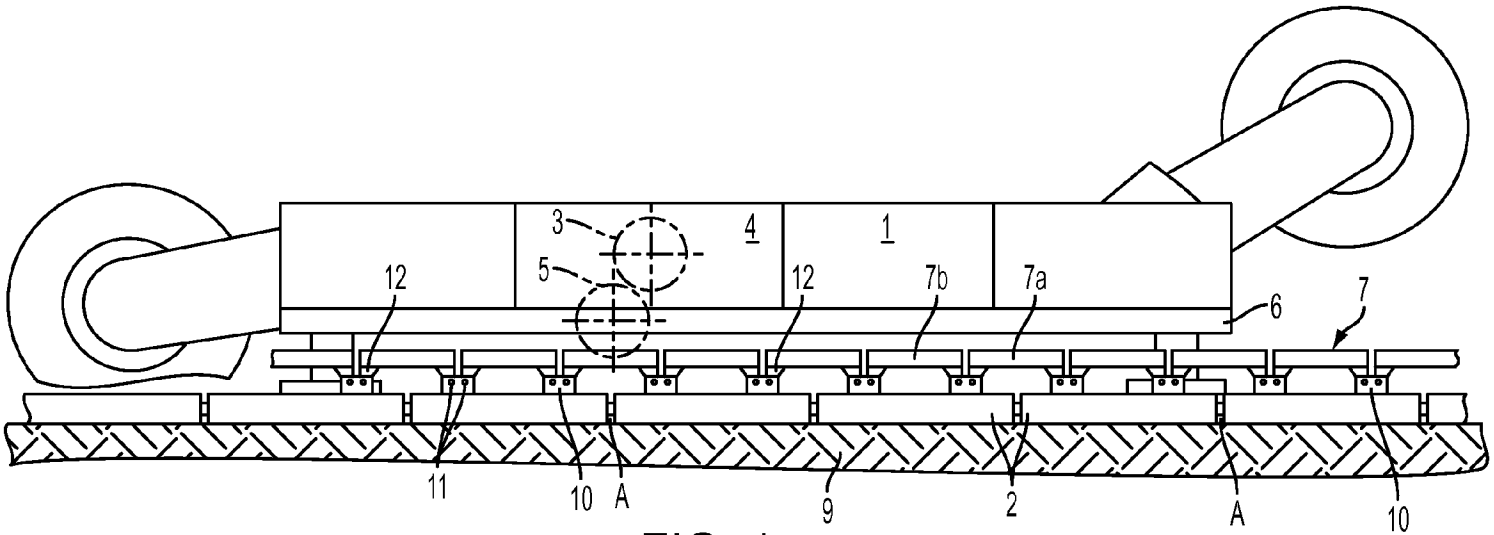
FIG. 1 PRIOR ART
FIG. 1 is a side elevation view of a prior art rack device for propelled movement by a drum-type cutter machine along a mine face.
Figure 2:
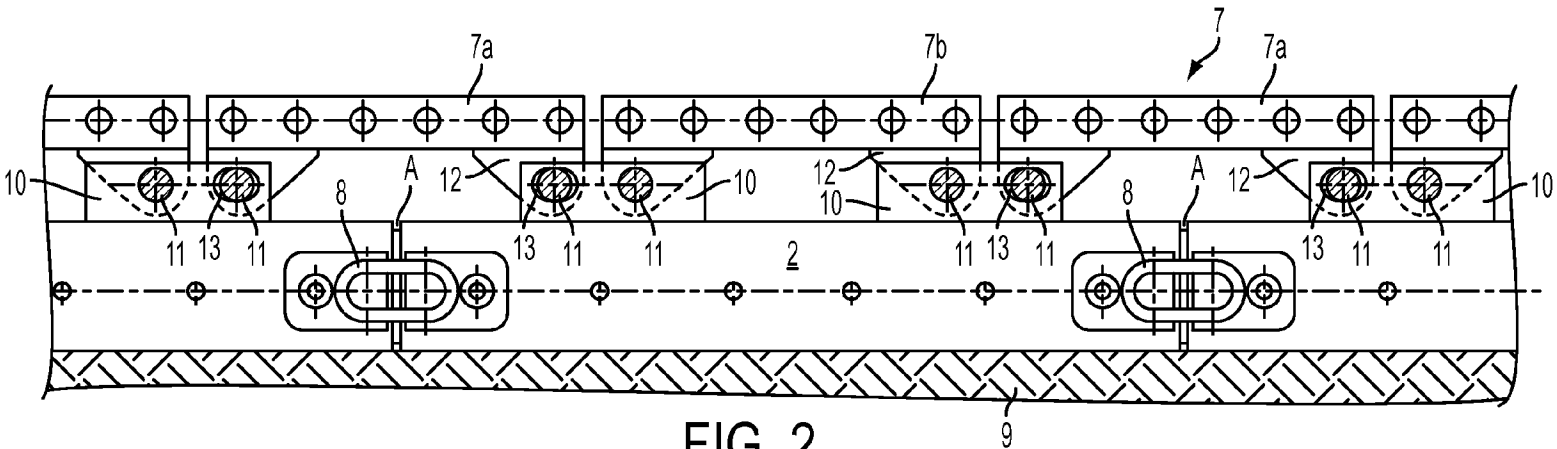
FIG. 2 PRIOR ART
FIG. 2 is an enlarged view of the rack device shown in FIG. 1 while supported by a face conveyor in its normal position.
Figure 3:
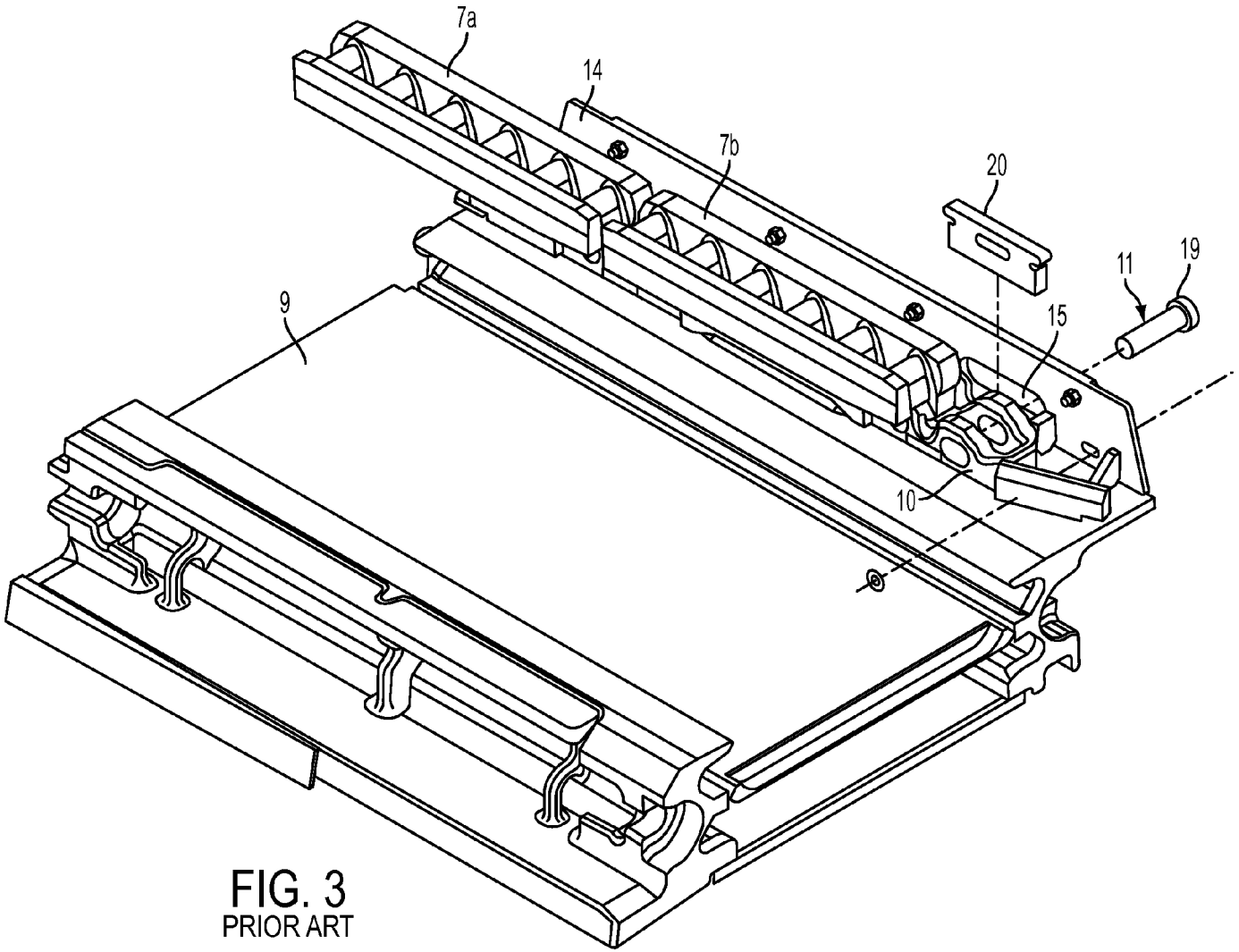
FIG. 3 PRIOR ART
FIG. 3 is an exploded perspective view of one of the line pans shown in FIG. 1.
Figure 5:
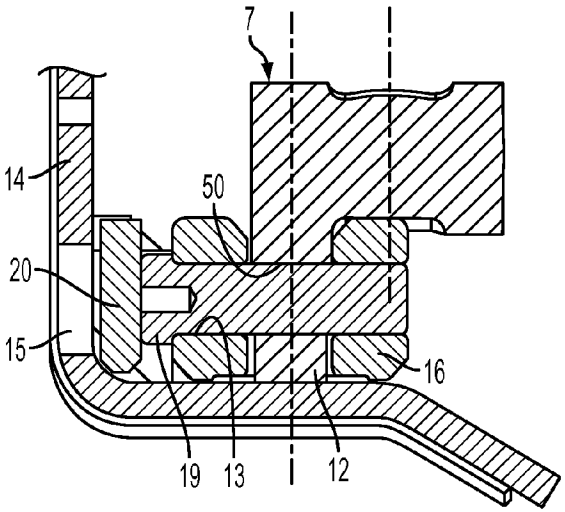
FIG. 5 PRIOR ART
FIG. 5 is a cross-sectional vertical view through the rack bar attachment to the clog shown in FIG. 4.
Figure 4:
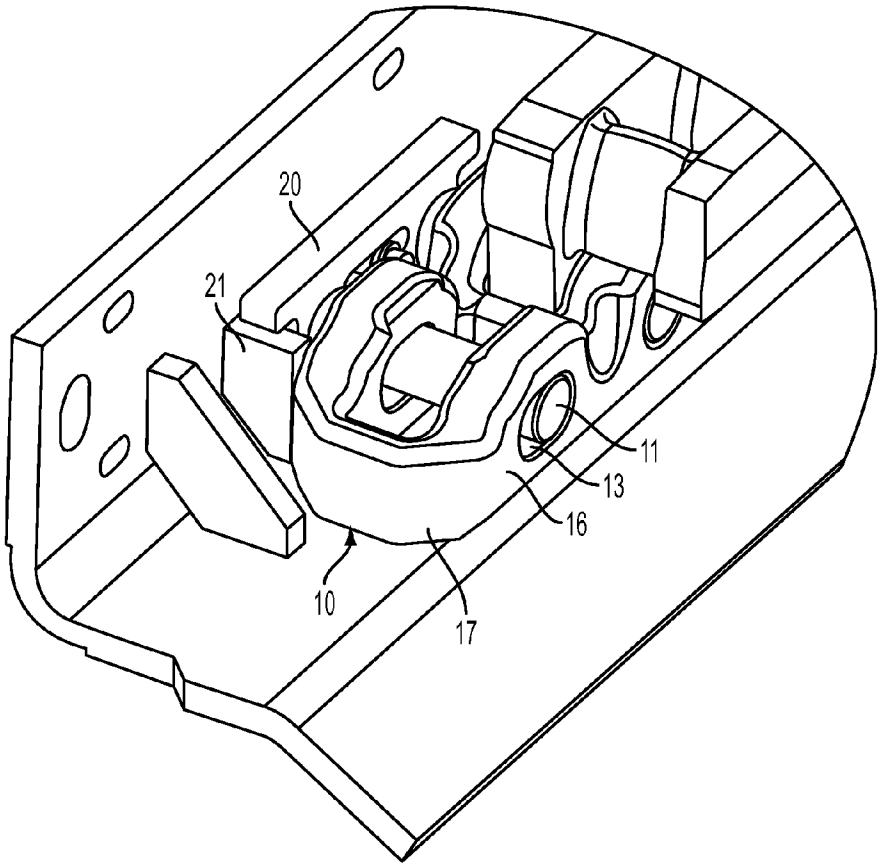
FIG. 4 PRIOR ART
FIG. 4 is a partial perspective view of the connection of one of the rack bars to a clog attached to a line pan.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

This description takes as its starting point the typical longwall conveyor fitted with rack haulage, as described above.

Figure 6:
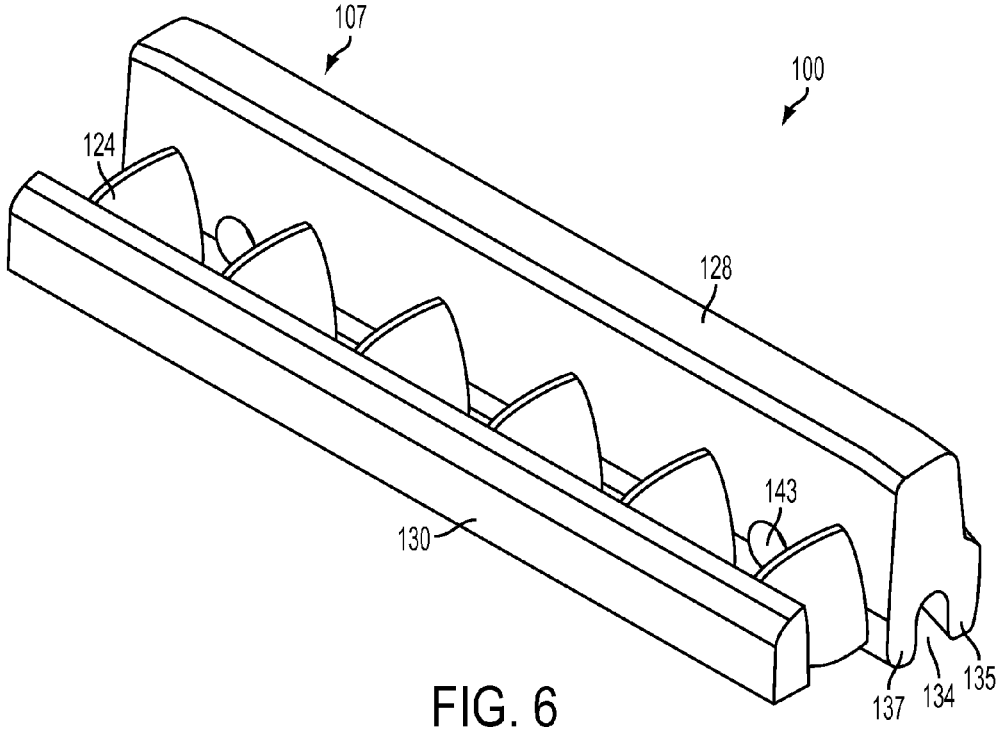
FIG. 6 is a top perspective view of an improved rack bar.
Figure 7:
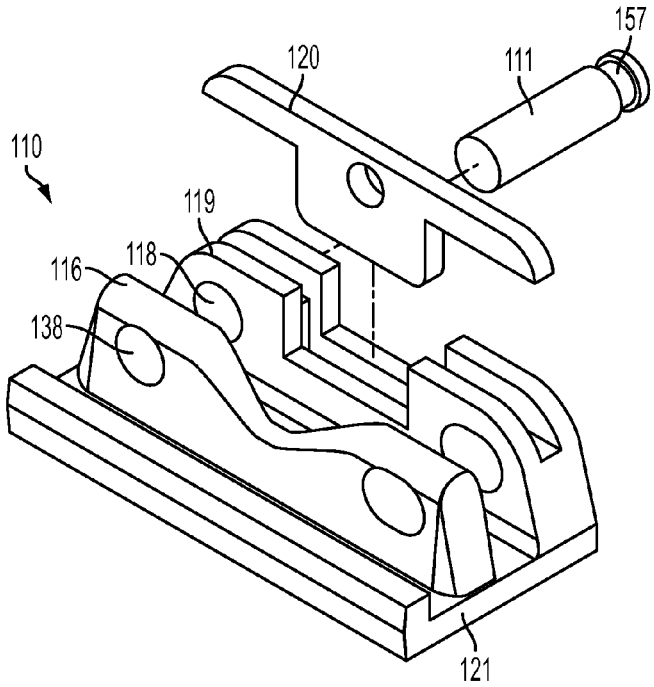
FIG. 7 is a perspective view of a clog and pin assembly, shown exploded.
Figure 8:
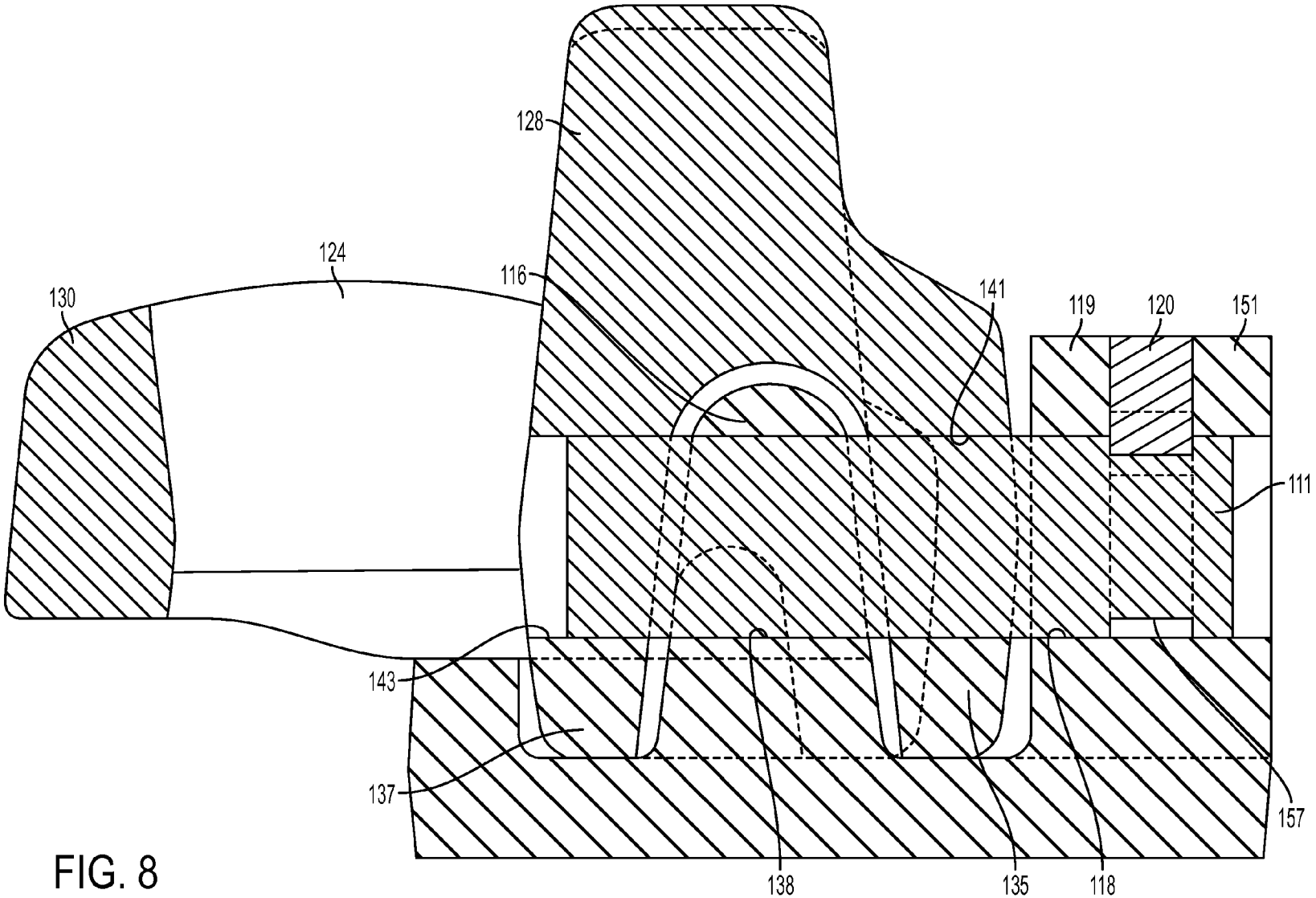
FIG. 8 is a vertical cross-sectional view of the assembled end of the rack bar and clog and pin assembly, taken through the pin connection.

More particularly, as illustrated in FIGS. 6-8, this disclosure provides a rack bar haulage system 100 forming part of a drive system for moving the mining machine along the conveyor, said rack bar haulage system 100 including a plurality of identical rack bars 107 (only one is shown in FIG. 6), each having spaced apart gear teeth 124 extending between cheek sections 128 and 130 at opposite sides of the rack bar 107.

The haulage system 100 also includes a clog 110 comprising two spaced apart sidewalls 116 and 119 attached to a base 121, and openings 118 and 138 through the sidewalls 116 and 119.

One cheek section 128 has a clog wall receiving cavity 134 adapted to receive one 116 of the clog sidewalls, the clog wall receiving cavity 134 being defined by spaced apart cheek section flanges 135 and 137, the cheek section flanges 135 and 137 each having an opening 141 and 143, respectively, there through. The cheek section flange openings 141 and 143 are aligned with the clog sidewall openings 118 and 138.

A pin 111 is insertable through the sidewall openings 118 and 138, and the openings 118 and 138 in the cheek section flanges 135 and 137. A pin support 151 is also provided in the clog 110 to receive a retainer plate 20 to hold the pin 111 in the clog 110. The plate 120 engages an indentation 157 in the end of the pin 111.

In the preferred embodiment, the spaced apart cheek sections 128 and 130 are positioned so that the envelope formed by the gear teeth 124 is generally aligned with or at about the same level on the rack bar 107 as the pin 111 for retaining the rack bar 107 in the clog 110.

As compared to the conventional rack bar, the gear teeth are substantially lower. This is beneficial when the longwall mining machine needs to operate in smaller mining material seams.

The one cheek section 128 is substantially higher than the other cheek section 130. This provides for the longwall mining machine to travel along the higher cheek section 128, while the drive gear engages the lower gear teeth 124. In other embodiments (not shown), the cheek sections may be of similar heights.

As a result of the pin 111 passing through the openings 118 and 138 in the clog sides, and the openings 141 and 143 in the cheek section flanges 135 and 137, the rack bars 107 are held securely in the clog 110, with the pin 11 in triple shear.

Various other features of this disclosure are set forth in the following claims.

The invention claimed is:

1. A system for hauling a shearer mining machine, the system comprising:

a rack including gear teeth and a pair of spaced apart cheek sections, the gear teeth extending between the two cheek sections, wherein one of the cheek sections includes first and second flanges defining a gap therebetween;

a clog supporting the rack, the clog defining a tooth-supporting surface and including a first sidewall that is spaced apart from the tooth-supporting surface and a second sidewall spaced apart from the first sidewall in a direction opposite from the tooth-supporting surface, wherein the first sidewall is positioned within the gap of the rack when the rack is supported by the clog, wherein each of the flanges includes an opening therethrough, the first sidewall of the clog includes an opening therethrough, and an opening is formed in the second sidewall; and a pin coupling the rack to the clog, wherein at least a portion of the pin is positioned above the tooth-supporting surface, wherein the pin is insertable through at least a portion of each of the flange openings, the first sidewall opening, and at least a portion of the second sidewall opening.

2. A system for hauling a shearer mining machine on a mine floor, the system comprising:

a rack including gear teeth, each of the gear teeth having a bottom surface, the bottom surfaces of the teeth defining a planar base surface that extends in a lateral direction substantially parallel to the mine floor, and the rack further including a pair of spaced apart cheek sections, the gear teeth extending between the two cheek sections, wherein one of the cheek sections includes first and second flanges defining a gap therebetween;

a clog supporting the rack, the clog includes a first sidewall that is spaced apart from the gear teeth and positioned within the gap of the rack when the rack is supported by the clog, and the clog includes a second sidewall spaced apart from the first sidewall in a direction opposite from the gear teeth, wherein each of the flanges includes an opening therethrough, the first sidewall of the clog includes an opening therethrough and an opening is formed in the second sidewal; and a pin coupling the rack to the clog, wherein at least a portion of the pin is positioned above the base surface, and further wherein the pin is insertable through at least a portion of each of the flange openings, the first sidewall opening, and at least a portion of the second sidewall opening.

3. A system for hauling a shearer mining machine on a mine floor, the system comprising:

a rack including a pair of spaced apart cheek sections, gear teeth extending therebetween, each of the teeth having a bottom surface, the bottom surfaces of the teeth defining a planar base surface that extends in a lateral direction substantially parallel to the mine floor, one of the cheek sections including first and second flanges defining a gap therebetween, each of the flanges having an opening therethrough;

a clog supporting the rack, the clog including a base, a first sidewall extending generally perpendicular to the base and positioned within the gap of the rack when the rack is supported by the clog, the first sidewall having an opening therethrough, a second sidewall extending generally perpendicular to the base and positioned below at least a portion of the gear teeth, and a third sidewall extending generally perpendicular to the base and spaced apart from the first sidewall in a direction opposite from the second sidewall, the third sidewall having an opening therethrough, wherein the first flange of the rack is positioned between the first and the second sidewalls and the second flange of the rack is positioned between the first and the third sidewalls; and a pin insertable through at least a portion of each of the flange openings, the first sidewall opening, and at least a portion of the third sidewall opening, wherein a least a portion of the pin is above the base surface.

4. The system of claim 3, wherein the second sidewall defines a top surface, and wherein the top surface supports the gear teeth of the rack.

5. A system for hauling a shearer mining machine, the system comprising:

a rack including gear teeth;

a clog supporting the rack, the clog defining a tooth-supporting surface;

a pin coupling the rack to the clog, at least a portion of the pin positioned above the tooth-supporting surface; and a shearer mining machine coupled to a pinion, wherein the pinion engages the rack, wherein the pinion includes pinion gear teeth, each of the pinion gear teeth having a top surface, the top surfaces of the pinion gear teeth defining an outside cylinder, and wherein at least a portion of the outside cylinder is positioned below a portion of the pin.

* * * * *

UNITED STATES PATENT AND TRADEMARK OFFICE

CERTIFICATE OF CORRECTION

PATENT NO. : 8,393,687 B2
APPLICATION NO. : 12/752833
DATED : March 12, 2013
INVENTOR(S) : Gordon Powell It is certified that error appears in the above-identified patent and that said Letters Patent is hereby corrected as shown below:

In the Claims:

Column 6, line 17 of claim 3 should read: portion of the third sidewall opening, wherein at least a Signed and Sealed this
Twenty-first Day of May, 2013

Teresa Stanek Rea
*Acting Director of the United States Patent and Trademark Office*